US006766658B2

(12) United States Patent
Scharf

(10) Patent No.: US 6,766,658 B2
(45) Date of Patent: Jul. 27, 2004

(54) SEGMENTED JEWELRY ITEM

(75) Inventor: Giuseppe Scharf, Jerusalem (IL)

(73) Assignee: Adipaz, Ltd., Jerusalem (IL)

( * ) Notice: Subject to any disclaimer, the term of this patent is extended or adjusted under 35 U.S.C. 154(b) by 0 days.

(21) Appl. No.: 10/287,007

(22) Filed: Nov. 6, 2002

(65) Prior Publication Data

US 2003/0115903 A1 Jun. 26, 2003

Related U.S. Application Data

(63) Continuation of application No. PCT/US02/06750, filed on Mar. 5, 2002

(60) Provisional application No. 60/284,742, filed on Apr. 17, 2001.

(51) Int. Cl.[7] ..... A44C 17/02

(52) U.S. Cl. ..... 63/31; 63/26

(58) Field of Search ..... 63/26, 31

(56) References Cited

U.S. PATENT DOCUMENTS

| | | | | | |
|---|---|---|---|---|---|
| 1,421,329 | A | | 6/1922 | Welch | |
| D70,217 | S | | 5/1926 | Garlin | |
| 1,730,257 | A | | 10/1929 | Welch | |
| 1,827,695 | A | | 10/1931 | Welch | |
| 1,850,190 | A | | 3/1932 | Welch | |
| 1,912,602 | A | | 6/1933 | Stonberg | |
| 2,258,413 | A | * | 10/1941 | Koven | 63/31 |
| D248,286 | S | | 6/1978 | Barr | |
| 4,208,888 | A | | 6/1980 | Erdman et al. | |
| 4,294,084 | A | * | 10/1981 | Lampert | 63/15 |
| 4,796,442 | A | * | 1/1989 | Sarcona | 63/26 |
| 5,454,234 | A | | 10/1995 | Karmeli | |
| 5,632,164 | A | | 5/1997 | Bergagnini | |
| 5,669,240 | A | | 9/1997 | Lima | |
| 5,839,211 | A | | 11/1998 | Pallera | |
| D427,379 | S | | 6/2000 | Thorpe | |
| D434,995 | S | | 12/2000 | Harkness | |
| D434,996 | S | | 12/2000 | Harkness | |
| 6,226,232 | B1 | * | 5/2001 | Ruchonnet | 368/223 |
| 6,324,868 | B1 | | 12/2001 | Chen et al. | |

FOREIGN PATENT DOCUMENTS

| | | | | |
|---|---|---|---|---|
| CA | 556182 | | 4/1958 | |
| DE | 2933309 | * | 3/1981 | 63/31 |
| DE | 296 17 252 | | 1/1997 | |
| FR | 335342 | | 9/1903 | |
| FR | 2273489 | | 1/1976 | |
| FR | 2344245 | * | 10/1977 | |
| FR | 2376638 | * | 8/1978 | |
| JP | 10-023911 | | 1/1998 | |

OTHER PUBLICATIONS

W. Magazine; Nov. 25–Dec. 2, 1977: Jewelers Circular–Keystone Oct. 1977, pp. 39, 70 & 82.

* cited by examiner

*Primary Examiner*—J. J. Swann
*Assistant Examiner*—Katherine Mitchell
(74) *Attorney, Agent, or Firm*—Katten Muchin Zavis Rosenman

(57) ABSTRACT

A gem setting for use with a ring or other jewelry item with internal divisions having pluralities of stones in each division. Each division houses a different type or color of stone, such that the groupings of similar stones are preferably restricted to a particular region on the jewelry face. The divisions may take the form of a variety of shapes and geometric configurations.

22 Claims, 2 Drawing Sheets

SEGMENTED JEWELRY ITEM

CROSS-REFERENCE TO RELATED APPLICATIONS

This application is a continuation of PCT/US02/06750, filed Mar. 5, 2002, now pending, which took priority under 35 U.S.C. §119(e) from U.S. Provisional Application 60/284,742 filed Apr. 17, 2001.

FIELD OF THE INVENTION

This invention relates generally to a jewelry item, and more particularly to an encased gem setting for particular use in a pendant, ring or other jewelry article.

BACKGROUND OF THE INVENTION

It is known to create gem settings that individually mount each of a plurality of gemstones (see, e.g., Canadian patent No. 556, 182, issued Apr. 22, 1958). It is also known to create gem settings that hold a plurality of unmounted gemstones in an enclosure (see, e.g., U.S. Pat. No. 1,850, 190, issued Mar. 22, 1932). However, it has not heretofore been known to create a gem setting that hold two or more pluralities of unmounted gemstones segmented in a predetermined geometric arrangement.

SUMMARY OF THE INVENTION

A novel gem setting comprises a base, a top, a partition joining the base and the top to define an enclosure, and one or more partitions subdividing the enclosure into at least two enclosed chambers. A plurality of unmounted gemstones is confined within said at least two chambers. The base and top are usually, but not necessarily transparent in order to permit viewing of the enclosure and gemstones. In one embodiment of the invention, the plurality of gemstones in at least one chamber are tightly packed to permit little or no movement of the gemstones. In another embodiment of the invention, the plurality of gemstones in at least one chamber are loosely packed to permit some movement of the gemstones. In yet another embodiment, the plurality of gemstones in at least one chamber all exhibit a uniform color. In another embodiment, the plurality of gemstones in at least one chamber exhibit varied colors. Chambers may be configured to represent familiar shapes. Gemstones may include synthetic as well as semi-precious and precious stones or particles of semi-precious and precious materials.

BRIEF DESCRIPTION OF THE DRAWINGS

A more complete understanding of the invention may be obtained by reading the following description of specific illustrative embodiments of the invention in conjunction with the appended drawing in which.

In the various figures, like reference numerals designate like or similar elements of the invention.

DETAILED DESCRIPTION OF THE PREFERRED EMBODIMENTS

The following detailed description includes a description of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
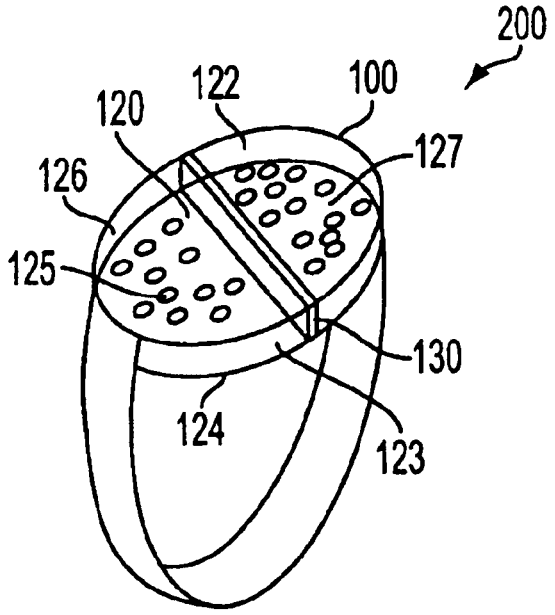
FIG. 1 is a perspective view of a jewelry item incorporating a first embodiment of the gem setting of the present invention.
Figure 2:
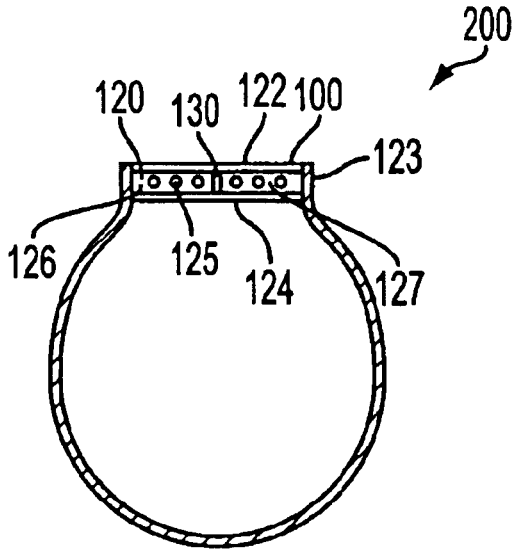
FIG. 2 is a cross sectional view of the ring of FIG. 1.

FIG. 1 is a perspective view and FIG. 2 is a cross sectional view of a jewelry item 200 incorporating a first embodiment of a gem setting 100 of the present invention. The gem setting 100 preferably comprises an enclosure 120 for enclosing precious stones and the like 125, said enclosure 120 defined between an upper surface 122, a lower surface 124 and a sidewall 123. Such enclosure 120 is preferably divided by a partition 130 into a plurality of chambers 126 and 127, each chamber 126, 127 holding one or more stones 125. The partition 130 is positioned between the upper and lower surfaces 122, 124 such that the partition 130 prevents stones from traveling between chambers. The partition 130 may be fixedly attached to one or both of the upper and lower surfaces 122, 124 of the gem setting 100 or the sidewall 123, and it is not necessary that the partition 130 span the entirety between the upper and lower surfaces 122, 124 to completely separate the enclosure into its respective chambers.

The surfaces 122, 124 may be formed from a variety of opaque, translucent or transparent materials. In a preferred embodiment of the present invention, such surfaces 122, 124 are formed from a transparent material such as glass. Such surfaces are also preferably continuous across the enclosure 120, although discontinuous upper and/or lower surfaces are contemplated. Sidewall 123 is typically formed in a conventional manner from a gem setting material such as, but not limited to, gold, gold-plated base metal or silver, while the partition 130 is typically formed in the same manner and with the same materials used to form the sidewall 123. While the figures illustrate a gem setting 100 incorporated into a ring 200 or the like, the gem setting of the invention may be incorporated into various other jewelry items such as, but not limited to, a pendant, cuff-link, necklace, bracelet, brooch, pin and the like.

Figure 3:
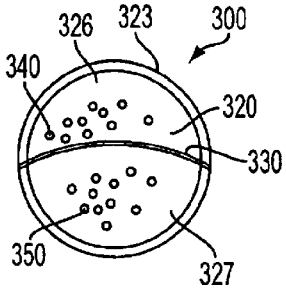
FIGS. 3–11 illustrate alternative embodiments of the gem setting of the invention.

FIG. 3 illustrates an alternative embodiment of the gem setting 300 of the present invention, having an enclosure 320 divided into chambers 326, 327 by an arc-shaped partition 330. Within the chambers 326, 327 are respective gemstone pluralities 340, 350, which gemstone pluralities are restricted to their respective chambers by virtue of the partition 330, upper and lower surfaces (see FIGS. 1 and 2) and sidewall 323. Each plurality of stones within each chamber is preferably defined by a consistent material characteristic. For instance, the plurality 340 in chamber 326 may be one color while the plurality 350 in chamber 327 is of a different color. Alternatively, the stones in each chamber may have the same ornamental appearance. Other characteristic variations, such as by size, hue, type of stone, and the like, may be employed. The stones may be precious, semi-precious or synthetic material, diamond, gold, silver, or other precious metals, formed in a variety of shapes and sizes, such as, but not limited to round and non-round particles, balls, nuggets and jewels. The sizes of the stones, particles, balls the like may vary from approximately 1–2 mm in width.

In FIG. 3, the pluralities of stones 340, 350 do not completely fill their respective chambers 326, 327, and as a result some stones may move freely within their respective chambers. This produces a dynamically aesthetic effect that is highly variable depending on the orientation of the gem setting.

Figure 4:
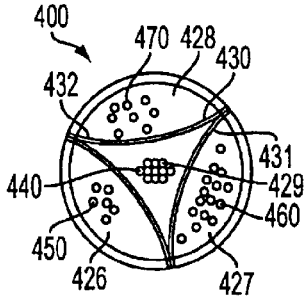

FIG. 4 is an alternative embodiment of a gem setting 400 of the present invention. In FIG. 4, dividing partitions 430, 431 and 432 define chambers 426, 427, 428 and 429. Centermost chamber 429 contains gemstone plurality 440, which includes stones that are sufficiently tightly packed so that said stones 440 are only partially movable. In other words, movement of these gemstones is limited or restricted. The pluralities of stones 450, 460 and 470 are freely movable within their respective chambers 426, 427 and 428.

Figure 5:
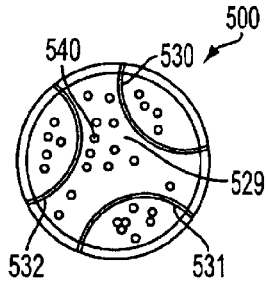

FIG. 5 illustrates a further alternative embodiment of a gem setting 500 of the present invention, having dividing partitions 530, 531 and 532 that define four chambers, including centermost chamber 529. However, in comparison to FIG. 4, centermost chamber 529 is enlarged to permit freer movement of stones in the plurality 540.

Figure 6:
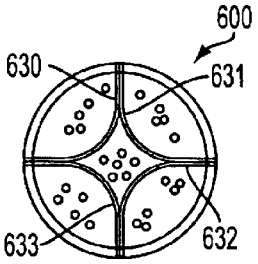

FIG. 6 illustrates a further alternative embodiment of a gemstone setting 600 of the present invention, in which four dividing partitions 630, 631, 632 and 633 define five chambers for the arrangement of gemstone pluralities.

Figure 7:
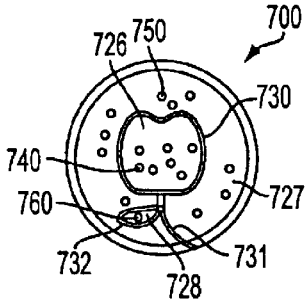

FIG. 7 illustrates a further alternative embodiment of a gemstone setting 700 of the present invention, wherein dividing partitions 730, 731 and 732 define chambers 726, 727 and 728 for stones 740, 750 and 760. Further, dividing partitions 730, 731 and 732 and their respective chambers form the familiar shape of an apple. Consistent with the apple motif, the stones provided in the gem setting 700 may be appropriately colored so that, for example, the stones 750 are white, the stones 740 are red and the stone 760 located in the leaf-shaped chamber 732 is green.

Figure 8:
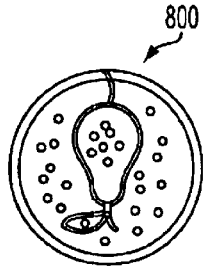
Figure 9:
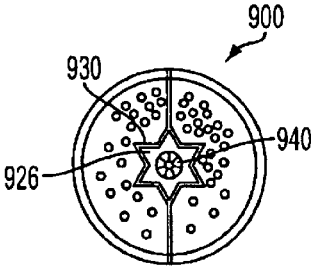
Figure 10:
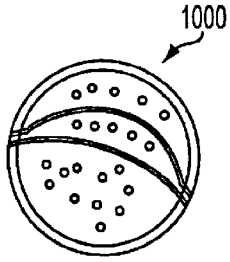

The settings illustrated in the figures are clearly only examples, since an endless variety of shapes and stone arrangements may be formed to vary the overall appearance of the setting. For instance, the partitions and gemstone pluralities may be arranged, for example, to form a setting 800 having the shape of a pear as illustrated in FIG. 8, or to form a setting 900 having the shape of a star as illustrated in FIG. 9, or to form a setting 1000 having the shape of a crescent moon as illustrated in FIG. 10, to name a few. With respect to FIG. 9, dividing partition 930 defines a chamber 926 containing a tightly-packed gemstone 940 that is capable of little or no movement within chamber 926. It should be noted that the present invention clearly contemplates many other variations of dividing partition configurations and shapes.

Figure 11:
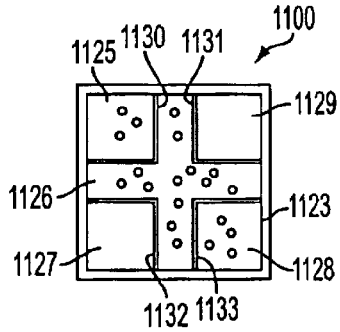

In addition to the dividing partitions having a variety of shapes and configurations, the sidewall enclosing partition may also have a variety of shapes or peripheral configurations. For instance, FIG. 11 illustrates a setting 1100 having a square-shaped sidewall enclosure 1123, partitions 1130–1133, chambers 1125–1129 and a variety of stones situated within said chambers. The enclosing sidewall partition may be a variety of shapes, such as oval, triangular, heart-shaped, octagonal, hexagonal, rectangular, polygonal or the like, and may be selected to conform with or complement shapes selected for the dividing partitions. Alternatively, it may be selected to conform with or complement a jewelry item in which the gem setting of the invention is incorporated.

The setting of the present invention is intended to be incorporated into a variety of jewelry items, such as a pendant, cuff-link, ring, brooch or the like. In some cases, the setting may even be removable and interchangeable between jewelry items. In addition, while each setting defines a plurality of chambers for housing pluralities of stones, not every chamber is required to be filled with stones as evidenced by empty chambers 1127 and 1129 of setting 1100 (see FIG. 11). Furthermore, the separate chambers may include stones of the same type or of different types depending on the desired visual effect.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A gem setting comprising:

an enclosed defined by a substantially transparent upper boundary surface, a substantially transparent lower boundary surface and a peripheral boundary surface, said peripheral boundary surface defining an inner edge directly adjacent the enclosure and an outer edge that the defines an outer surface of the gem setting adaptable to be grasped by a human during normal use of the gem setting;

at least one partition positioned between the upper and lower boundary surface and fixedly attached directly to the inner edge of the peripheral boundary surface at at least one location along the inner edge and dividing the enclosure into at least two chambers;

at least one of a first gemstone confinedly positioned in one of said at least two chambers; and a plurality of second gemstones confinedly positioned in another of said at least two chambers and being movable within said respective chamber.

2. The gem setting of claim 1, wherein the upper and lower boundary surfaces are formed of glass.

3. The gem setting of claim 1, said plurality of second gemstones further comprises varied ornamental characteristics.

4. The gem setting of claim 1, wherein the plurality of second gemstones are numerous so as to be only slightly movable within said another of said at least two chambers.

5. The gem setting of claim 1, wherein said at least one of said first gemstone further comprises a plurality of first gemstones.

6. The gem setting of claim 5, wherein said plurality of first gemstones are movable within said one of said at least two chambers.

7. The gem setting of claim 1, wherein each of the gemstones includes gemstones selected from the group consisting of precious gemstones, semi-precious gemstones, synthetic gemstones, diamonds, gold, silver, precious metals, particles and balls.

8. The gem setting of claim 7, wherein at least one of the gemstones comprises synthetic gemstones.

9. The gem setting of claim 7, wherein the gemstones only consist of balls made from precious metals.

10. The gem setting of claim 1, wherein said at least one partition is arranged to represent a preselected shape.

11. The gem setting of claim 10, wherein a characteristic of each of the gemstones is unique to and characteristic of the preselected shape of the chamber housing said gemstones.

12. The gem setting of claim 10, wherein the preselected shape is selected from the group consisting of circles, polygons, fruits, symbolic, decorative and geometric shapes.

13. The gem setting of claim 10, wherein the preselected shape is selected from the group consisting of apple shapes, pear shapes, crescent shapes and star shapes.

14. The gem setting of claim 1, wherein one of either the first or second gemstones has a width in the range of approximately 1–2 millimeters.

15. The gem setting of claim 1, wherein said at least one partition further comprises a plurality of partition dividers that divide said enclosure into at least three chambers.

16. The gem setting of claim 15, wherein each of said chambers further comprises a plurality of gemstones.

17. The gem setting of claim 16, wherein each gemstone in said plurality is movable with respect to each other in each of said chambers.

18. The gem setting of claim 15, wherein at least one chamber is empty.

19. The gem setting of claim 1, wherein the at least one partition is fixed attached directly to the inner edge of the peripheral boundary surface at only one location along the inner edge.

20. A jewelry item incorporating a gem setting, wherein the gem setting comprises:

an enclosure defined by a substantially transparent upper boundary surface, a substantially transparent lower boundary surface and a peripheral boundary surface, said peripheral boundary surface defining an inner edge directly adjacent the enclosure and an outer edge that the defines an outer surface of the jewelry item adaptable to be grasped by a human during normal use of the jewelry item;

at least one partition positioned between the upper and lower boundary surface and fixedly attached directly to the inner edge of the peripheral boundary surface at at least one location along the inner edge and dividing the enclosure into at least two chambers;

at least one of a first gemstone confinedly positioned in one of said at least two chambers; and a plurality of second gemstones confinedly positioned in another of said at least two chambers and being movable within said respective chamber.

21. The gem setting of claim 20, wherein the at least one partition is fixedly attached directly to the inner edge of the peripheral boundary surface at only one location along the inner edge.

22. The gem setting of claim 20, wherein the gemstones only consist of balls made from precious metals.

* * * * *